US007759035B2

(12) United States Patent
Ninomiya et al.

(10) Patent No.: US 7,759,035 B2
(45) Date of Patent: Jul. 20, 2010

(54) ELECTROSTATIC CHARGE IMAGE DEVELOPING TONER AND IMAGE FORMING METHOD

(75) Inventors: Hidetaka Ninomiya, Tokyo (JP); Mikio Kouyama, Tokyo (JP); Takato Chiba, Tokyo (JP); Kenji Hayashi, Tokyo (JP); Hiroyuki Yasukawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 734 days.

(21) Appl. No.: 11/565,999

(22) Filed: Dec. 1, 2006

(65) Prior Publication Data

US 2007/0184375 A1 Aug. 9, 2007

(30) Foreign Application Priority Data

Feb. 8, 2006 (JP) ..... 2006-030730

(51) Int. Cl.
*G03G 9/09* (2006.01)

(52) U.S. Cl. ..... 430/108.1; 430/108.2; 430/108.21; 430/108.5; 430/123.5; 430/123.57

(58) Field of Classification Search ..... 430/180.21, 430/108.1, 108.2, 108.5, 123.5, 123.57
See application file for complete search history.

(56) References Cited

U.S. PATENT DOCUMENTS

| | | | | |
|---|---|---|---|---|
| 5,892,033 | A * | 4/1999 | Komamura et al. | 544/225 |
| 6,187,495 | B1 * | 2/2001 | Chiba et al. | 430/108.23 |
| 2006/0093935 | A1 * | 5/2006 | Ono et al. | 430/108.1 |

FOREIGN PATENT DOCUMENTS

| | | | |
|---|---|---|---|
| JP | 01-172976 | A * | 7/1989 |
| JP | 7043932 | A | 2/1995 |
| JP | 7043933 | A | 2/1995 |
| JP | 07-096163 | A * | 4/1995 |
| JP | 1172975 | A | 7/1998 |
| JP | 2004-077707 | A * | 3/2004 |
| WO | 03/020831 | A1 | 3/2003 |

OTHER PUBLICATIONS

WPI/Thomas English-language abstract, AN 1996-162438, describing JP 07-020651 (pub. Jan. 1995).*
WPI/Thomas English-language abstract, AN 1995-119576, describing JP 07-043933 (pub. Feb. 1995).*
WPI/Thomas English-language abstract, AN 1989-238013, describing JP 01-172975 (pub. Jul. 1989).*
WPI/Thomas English-language abstract, AN 1994-257405, describing JP 06-130715 (pub. May 1994).*
WPI/Thomas English-language abstract, AN 1995-094745, describing JP 07-020652 (pub. Jan. 1995).*
WPI/Thomas English-language abstract, AN 1995-119575, describing JP 07-043932 (pub. Feb. 1995).*
Japanese Patent Office machine assisted translation of JP 2004-077707 (pub. Mar. 2004).*
Japanese Patent Office machine assisted translation of JP 07-096163 (pub. Apr. 1995).*
Japanese Patent Office English-language abstract describing JP 01-172976A, copyright 1989.*
Derwent abstract, Acc. No. 1989-238014, describing JP 01-172976A, Nov. 1996.*
Diamond, A.S. et al., ed., Handbook of Imaging Materials, Second Edition, Marcel Dekker, Inc., NY (2002), pp. 146-148.*

* cited by examiner

*Primary Examiner*—Janis L Dote
(74) *Attorney, Agent, or Firm*—Lucas & Mercanti, LLP

(57) ABSTRACT

An object is to provide an electrostatic charge image developing toner and an image forming method using the same capable of maintaining image properties for a long duration, which exhibit not only sufficient transparency and chromaticness, accompanied with high color reproduction and excellent charging characteristic, but also excellent heat resistance, together further with excellent light fastness and sufficient image holding ability. Disclosed is an electrostatic charge image developing toner of the present invention comprising a binder resin for toner particle formation and colorant particles dispersed in the binder resin, wherein the colorant particles comprise a dye and an antioxidant. Further, the electrostatic charge image developing toner wherein a volume-based median particle diameter of the colorant particles is preferably 10-100 nm, and also the dye contained in the colorant particles is preferably an oil-soluble dye or a metal chelate dye.

6 Claims, No Drawings

ELECTROSTATIC CHARGE IMAGE DEVELOPING TONER AND IMAGE FORMING METHOD

This application claims priority from Japanese Patent Application No. 2006-030730 filed on Feb. 8, 2006, which is incorporated hereinto by reference.

TECHNICAL FIELD the present invention relates to an electrostatic charge image developing toner and an image forming method usable for an electrophotographic method.

BACKGROUND

In image formation based on electrophotographic technology, light information is applied to an electrostatic charge image carrier containing a photoconductive substance in response to the images information by various methods, and an electrostatic charge image is formed on the aforementioned electrostatic charge image carrier. Then the electrostatic charge image is developed as a toner image by charged toner and this toner image is transferred onto a recording medium such a paper. The image is then fixed by heat, pressure or solvent vapor in the fixing process, whereby a visible image is obtained.

In the formation of a full color image based on the aforementioned electrophotographic technology, electrostatic charge images are formed on an electrostatic charge image carrier with the color toner of yellow, magenta, cyan or black by the image information broken down into each color. These images each are developed to get each color toner image corresponding to each image information. These images are then superimposed, transferred and fixed in the fixing step, whereby a full color image is obtained.

Such color toner is exemplified by the yellow toner, magenta toner, cyan toner and black toner formed from toner particles prepared via dispersion of each of yellow, magenta, cyan and black colorant. The conventionally known organic pigment and dye have been used as the colorant used in color toner, and they each have various defects.

For example, the organic pigment is generally superior to dye in heat resistance and light fastness. However, the organic pigment is dispersed in the form of coagulated particles in the binder resin, and yet its dispersibility is low. This will increase the opacifying power of toner and reduces the transparency. In the image having been formed, the undermost layer of the color toner layers of each of colors having been superimposed will be covered by the upper layers, with the result that the visibility of the toner color of the undermost layer, chromaticness and the image color reproduction are reduced. In principle, all colors can be reproduced by the subtractive color mixture process using the three primary colors of yellow, magenta and cyan. However, when a color image is formed by the color toner including the pigment, the color, range and chromaticness to be reproduced may be limited in practice by the spectral characteristic at the time of dispersing the pigment in the binder resin, and the color mixture at the time of mixing the toner of different colors. This may lead to a failure in ensuring a faithful reproduction of the document color.

To solve the aforementioned problems of the pigment, the flashing method for dispersing the pigment is used. This method makes it possible to achieve the size of the particle dispersed on the order of submicron by primary particles free of coagulated secondary particle. The technique of improving the transparency using this method has been proposed.

Another technique having been proposed is the one for improving the electrostatic charging property, fixing performance and image uniformity by covering the particle-like pigment with the binder resin and outer-shell resin.

However, the aforementioned means fails to the meet the requirements of ensuring the sufficient transparency and chromaticness of the toner containing pigments as colorants.

On the one hand, proposed examples of the toner using a dye exhibiting excellent color reproduction and transparency as a colorant include toner using an oil-soluble dye, toner using a colorant in which a reactive dye adheres to silica, toner using a colorant strengthened by a polymer dye or such, and toner using a colorant mixing a pigment and a dye. However, the dye is generally present as it is dissolved in the binder resin for toner particle formation constituting the toner particles, and therefore exhibits excellent transparency and chromaticness. For the characteristics thereof, the light fastness and heat resistance are far inferior to those of the pigment. Since it is interior in heat resistance, the dye will be decomposed by heat and image density will be reduced. Further, when the toner image is to be fixed by a contact heating process, the dye may be sublimated by heat, with the result that the apparatus is contaminated. Furthermore, the dye may be dissolved into the silicone oil used at the time of fixing, and may be transferred fused onto the heating roll in the final phase, so that offset phenomenon occurs. This problem has actually taken place.

A technique having been proposed to solve the aforementioned problem with the dye is exemplified by a method of ensuring compatibility among light fastness, heat resistance and color reproduction by using a specific anthraquinone based dye. However, the aforementioned method is not yet powerful enough to provide toner exhibiting sufficient heat resistance (sublimation property) and light fastness.

Another technique having been proposed to solve the foregoing problem with the dye is also exemplified by a method for producing the encapsulated toner, wherein the core particle containing the polymer resin and colored dye is covered by a shell layer polymer (refer to Patent Document 1, for example).

However, this technique is still insufficient to provide toner exhibiting sufficient heat resistance and light fastness.

As a technique proposed to solve a problem with the dye, there is a method of producing toner in which a black dye and an antioxidant are dispersed in a solvent to prepare colored particles by adding polymerizable particles, in order to avoid color fading or discoloration (refer to Patent Document 2, for example).

However, after dispersing or dissolving constituent materials of polymerizable particles in a solvent, a process of removing the solvent or such is desired to be conducted in order to acquire sufficient light fastness by impregnating a dye and an antioxidant inside the polymerizable particles, and also the simple coexistence of a dye and an antioxidant, together with polymerizable particles result in the slight deposit amount adhering on the surface of polymerizable particles. Since the dye and the antioxidant are not also present in a strong interaction, the antioxidant effect tends not to be obtained effectively. It is also difficult to obtain sufficient heat resistance.

After dispersing or dissolving in an organic solvent a resin and a dye which are possible to be reacted with each other, disclosed is a method of removing a solvent to prepare a toner by reacting these resin and dye (refer to Patent Document 3, for example).

However, in the case of a toner disclosed in Patent Document 3, insufficient light fastness is possibly obtained, since the antioxidant relating to the toner storing for a long duration tends to be deactivated, though a dye is fixed to a resin, whereby high heat resistance is obtained. There is also a problem such that a charging characteristic between toner particles is extremely uneven, since a dye is to be present on the toner particle surface.

(Patent Document 1) Japanese Patent O.P.I. Publication No. 5-72792

(Patent Document 2) Japanese Patent O.P.I. Publication No. 6-148928

(Patent Document 3) Japanese Patent O.P.I. Publication No. 2004-77707

SUMMARY

The present invention was made on the basis of the above-described situation. It is an object of the present invention to provide an electrostatic charge image developing toner and an image forming method using the same capable of maintaining image properties for a long duration, which exhibit not only sufficient transparency and chromaticness, accompanied with high color reproduction and excellent charging characteristic, but also excellent heat resistance, together further with excellent light fastness and sufficient image holding ability. Disclosed is an electrostatic charge image developing toner comprising a binder resin for toner particle formation and colorant particles dispersed in the binder resin, wherein the colorant particles comprise a dye and an antioxidant.

DESCRIPTION OF THE PREFERRED EMBODIMENTS

An electrostatic charge image developing toner of the present invention comprising toner particles, each toner particle comprising colorant particles dispersed in a binder resin, wherein the colorant particles comprise a dye and an antioxidant.

The electrostatic charge image developing toner, wherein a volume-based median particle diameter of the colorant particles is preferably 10-100 nm.

The electrostatic charge image developing toner, wherein a weight ratio of the antioxidant to the dye (antioxidant/dye) is preferably in the range of 0.1/1-1/1.

The electrostatic charge image developing toner, wherein the dye contained in the colorant particles is preferably an oil-soluble dye or a metal chelate dye.

The electrostatic charge image developing toner, wherein the colorant particles further comprise a dye medium resin differing in kind from the binder resin.

Further, the electrostatic charge image developing toner, wherein the colorant particles preferably contain at least one dye medium resin, and the at least one dye medium resin preferably has a weight average molecular weight (Mw) of at least 500 and less than 40,000.

Provided is an electrostatic charge image developing toner of the present invention, wherein the antioxidant contained in the colorant particles comprises a compound represented by following Formula (A) or (B).

Formula (A)

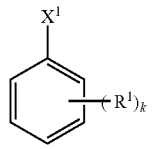

[In Formula (A), $X^1$ represents —$OR^2$ or —$N(R^3)R^4$, and $R^1$ represents —$OR^5$, —$N(R^6)R^7$, —$SR^8$, an alkyl group, an aryl group, —$COX^1$, a cyano group, a nitro group or a halogen atom. $R^1$-$R^8$ each represent an alkyl group or an aryl group, which may be substituted or unsubstituted. Symbol k is an integer of 0-5, and $R^1$-$R^8$ each may be identical or nonidentical with each other when k is 2 or more.]

Formula (B)

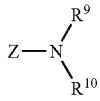

[In Formula (B), Z represents a hydrogen atom, an alkyl group, an aryl group or —OY. $R^9$ and $R^{10}$ each represent a hydrogen atom, an alkyl group which may be substituted or unsubstituted, or an aryl group which may be substituted or unsubstituted. Y represents an alkyl group which may be substituted or unsubstituted, an aryl group which may be substituted or unsubstituted, or a radical. $R^9$ and $R^{10}$ each may be identical or nonidentical with each other.]

It is a feature to provide an image forming method employing the electrostatic charge image developing toner of the present invention, comprising the steps of developing an electrostatic charge image formed on an electrostatic charge image carrier with the electrostatic charge image developing toner, and transferring a toner image formed in step (a) onto an image recording medium.

DETAILED DESCRIPTION OF THE INVENTION

Next, the present invention will be described in detail.

The electrostatic charge image developing toner (hereinafter simply referred to also as "toner") of the present invention is toner in which colorant particles are dispersed in a binder resin for toner particle formation (hereinafter referred to also as "toner binder resin") constituting the toner particle, and the colorant particle contains at least a dye and an antioxidant.

As to these colorant particles, a dye and an antioxidant are evenly distributed substantially, and also the dye and the antioxidant are not dissolved in a binder resin. Dye breeding and so forth are avoided since colorant particles are not dissolved in a toner binder resin, or in other words, the colorant particles are maintained in the form of solids. Further, high light fastness and heat resistance are exhibited to the dye and the antioxidant, since the dye and the antioxidant appearing onto the toner particle surface are prevented.

Regarding the toner of the present invention, colorant particles dispersed in a toner binder resin, constituting the toner particles preferably have a volume-based median particle diameter of 10-500 nm, more preferably have a volume-based median particle diameter of 10-100 nm, and still more preferably have a volume-based median particle diameter of 10-50 nm. In the case of colorant particles having a volume-based median particle diameter of less than 10 nm, the resulting toner exhibits low stability in colorant particles, together with low light fastness, since the surface area per unit volume becomes extremely large. On the other hand, in the case of colorant particles having a volume-based median particle diameter exceeding 500 nm, the resulting toner exhibits lowered chromaticness per unit dye, and the resulting visual images also exhibit low transmission caused by light scattering.

In order to control and adjust a volume-based median particle diameter of colorant particles dispersed in toner to 10-500 nm, it can be controlled by adjusting shear stirring stress during stirring, viscosity of a hydrophobic organic solvent solution and so forth, or by adding an appropriate kind and amount of surfactant into an aqueous medium, when the colorant particles are prepared employing the after-described submerged desiccation method.

As to the toner of the present invention, colorant particles dispersed in a toner binder resin preferably have a CV value of 10-100, more preferably have a CV value of 10-50, and still more preferably have a CV value of 10-30. In the case of the CV value of colorant particles dispersed in a toner binder resin being in the above described range, the resulting toner exhibits an even charging characteristic between toner particles substantially, whereby formed images exhibit extremely excellent chromaticness.

The CV value represented as a particle diameter distribution of colorant particles can be calculated from following Equation (1) by measuring the volume-based median particle diameter, and finding the cumulative curve by setting the total value to 100%; and particle diameters corresponding to 16%, 50% and 84% of the cumulative curve are designated as $d_{16}$, $d_{50}$ and $d_{84}$, respectively.

$$CV\text{ value}=\{(d_{84}-d_{16})/(2\times d_{50})\}\times 100 \qquad \text{Equation (1):}$$

The volume-based median particle diameter of the colorant particle can be determined by a dynamic light scattering method, laser diffraction method, centrifugal sedimentation method, FFF method or electric detector method. In the present invention, it is preferably measured by the dynamic light scattering method employing "Microtrack UPA-150" (produced by Nikkiso Corporation).

Regarding the content of a dye or an antioxidant in the colorant particle, the dye content and the antioxidant content are preferably 10-95% by weight and 5-90% by weight, respectively. It is preferable that a weight ratio of the antioxidant to the dye (antioxidant/dye) is also in the range of 0.1/1-1/1 in view of color reproduction and light fastness. In the case of colorant particles containing a dye medium resin, the content of the dye medium resin is preferably 30-70% by weight, based on the total weight. In this case, it is preferable that not only the dye content is 30-70% by weight, but also the ratio of the antioxidant to the dye is in the above-described range.

Colorant particles dispersed in a toner binder resin for the toner of the present invention may contain one or more different kinds of dye medium resin together with a dye and an antioxidant. Thus, the colorant particles contain the dye medium resin, whereby the colorant particles exhibit high dispersion stability, and the particle diameter can be stably controlled. The different kind of resin from the toner binder resin here means a resin having a low degree of compatibility with the foregoing toner binder resin in the process of manufacturing the toner. For example, even if the resin has a high degree of compatibility with the toner binder resin, as a result, a resin resulting in incompatibility is included, since the glass transition temperature of either one of the two resins or both is extremely higher than a temperature in the manufacturing process.

In the toner of the present invention, the colorant particles dispersed in the toner binder resin may be core-shell structure particles containing core particles made of a dye and an antioxidant, and shell layers made of shell layer-forming resin (hereinafter also referred to as "shell resin") covering the outer peripheral surface thereof, and substantially containing no dye. In this case, the shell resin is made of a different kind of resin from the toner binder resin, and the examples of the combination between the shell resin and toner binder resin are the same examples as those mentioned above. The colorant particles exhibit high production stability as well as storage stability, since the colorant particles are those composed of a core-shell structure.

In this core-shell structure colorant particle, the core particle may be completely covered by the shell layer or part of the core particle can be covered thereby. Further, part of the shell resin constituting the shell layer can form a domain and such in the core particle. Furthermore, the shell layer can contain a multi-layered structure including two or more layers. In this case, it is sufficient only if the resin constituting the outermost layer should be a different kind of resin from the toner binder resin.

<Process of Producing Toner>

Examples of methods to produce toner of the present invention include a kneading/pulverization method, a suspension polymerization method, an emulsion polymerization method and an emulsion polymerization coagulation method, an encapsulation method and other commonly known methods, but the emulsion polymerization coagulation method is preferable as a method of producing toner in view of production cost and production stability, since toner downsized in diameter is desired to be obtained in order to achieve high image quality.

The emulsion polymerization coagulation method is a method of producing toner particles possessing the steps of: mixing a dispersion of particles made of a toner binder resin (hereinafter, referred to as "toner binder resin particle") produced via an emulsion polymerization method; conducting coagulation slowly while balancing repulsion force of the particle surface caused by pH adjustment and coagulation force generated via addition of a coagulant composed of an electrolyte material; and conducting an association process while controlling an average particle diameter and a particle size distribution and simultaneously controlling the shape via association between particles by heating while stirring.

To produce toner of the present invention, the toner binder resin particles formed in using the emulsion polymerization coagulation method can be made of two or more layers of binder resins having different compositions. In this case, a polymerization initiator and polymerizable monomer are added to the dispersion liquid of the first resin particles prepared by the process of emulsion polymerization (first polymerization) according to the conventional method. This system is subjected to the process of polymerization (second polymerization), wherein the toner of the present invention is manufactured.

The emulsion polymerization coagulation method used to produce the toner of the present invention as an specific example includes: (1) a colorant particle-forming process for obtaining colorant particles containing an antioxidant and a dye medium resin if desired; (2) a toner binder resin particle polymerization process for obtaining toner binder resin particles containing an offset inhibitor and an electrostatic charge control agent if desired; (3) a salting-out/coagulation/fusion process for forming toner particles via salting out, coagulation and fusion of the toner binder resin particles, colorant particles in an aqueous medium; (4) filtering and rinsing process for filtering out the toner particle from the dispersion system of the toner particle (aqueous medium) and removing the surfactant and others from the toner particle; (5) a drying process of drying the toner particles having been rinsed and processed; and (6) a process of adding external additives into the toner particles having been rinsed and processed.

The "aqueous medium" refers to the medium prepared from 50-100% by weight of water and 0-50% by weight of water-soluble organic solvent. The water-soluble organic solvent is exemplified by methanol, ethanol, isopropanol, butanol, acetone, methyl ethyl ketone, and tetrahydrofuran. The alcohol based organic solvent that does not dissolve resins is preferably used.

The colorant particles constituting the toner of the present invention can be prepared employing a submerged desiccation method by which colorant particles are precipitated by removing a hydrophobic organic solvent, after emulsifying and dispersing in an aqueous medium a dye-containing solution in which a dye and an antioxidant are dissolved and dispersed in the hydrophobic organic solvent such as ethyl acetate or toluene, employing a homogenizer. When the colorant particles contain a dye medium resin, the dye medium resin is further dissolved via the dye-containing solution to obtain colorant particles with the above-described submerged desiccation method. Further, when the colorant particles are composed of a core-shell structure, emulsion polymerization is conducted by adding core particles containing a dye and an antioxidant acquired via the submerged desiccation method, and a polymerizable monomer into an aqueous medium containing a surfactant to form a shell layer by precipitating the foregoing polymerizable monomer onto to core particle surface via polymerization of the polymerizable monomer, whereby colorant particles having a core-shell structure can be obtained.

The emulsion homogenizer employed in a submerged desiccation method is not particularly limited, and a ultrasonic homogenizer, a high-speed stirring type homogenizer and the like, for example, are usable.

[Surfactant]

In the submerged desiccation method, if desired, any of commonly known cationic, anionic, amphoteric and nonionic surfactants is usable as an emulsifier. Of these, an anionic surfactant and a nonionic surfactant are preferable, and both the surfactants are also usable in combination in order to satisfy a predetermined condition.

Listed as anionic surfactants, for example, may be higher fatty acid salts such as sodium oleate; alkylarylsulfonic acid salts such as sodium dodecylbenzenesulfonate; alkylsulfuric acid ester salts such as sodium laurylsulfate; polyoxyethylene alkyl ether sulfuric acid ester salts such as polyoxyethylene lauryl ether sodium sulfate; polyoxyethylene alkyl aryl ether sulfuric acid ester salts such as polyoxyethylene nonyl phenyl ether sodium sulfate; and alkylsulfosuccinic acid ester salts such as sodium monooctylsulfosuccinate, sodium dioctylsulfosuccinate, polyoxyethylene sodium laurylsulfosuccinate, and derivatives thereof. Examples of dispersants also include SNB, MS, N, SSL, ST and P produced by Kao Corporation. Examples of the polymeric surfactant include styrene-acrylic acid-acrylic acid alkyl ester copolymers, styrene-acrylic acid copolymers, styrene-maleic acid-acrylic acid alkyl ester copolymers, styrene-maleic acid copolymers, styrene-methacrylic acid-acrylic acid alkyl ester copolymers, styrene-methacrylic acid copolymers, styrene-maleic acid monoester copolymers, vinylnaphthalene-acrylic acid copolymers, and vinylnaphthalene-maleic acid copolymers. As another polymeric surfactant, provided is JONCRYL (produced by Johnson Polymer Co.), which is an acryl-styrene based resin. A compound containing both a monomer group and a surfactant component, which is known as a reactive emulsifier, is also useful, since its solubility is low and its emulsion performance is high. Examples of reactive emulsifiers include LATEMUL series (produced by Kao Corporation) such as LATEMUL S-120, LATEMUL S-120A, LATEMUL S-180, and LATEMUL S-180A; EREMINOL JS series (produced by Sanyo Chemical Industry Co., Ltd.) such as EREMINOL JS-2 and so forth; NE series (produced by Adeka Corporation) such as ADEKA REASOAP NE-10, ADEKA REASOAP NE-20 and ADEKA REASOAP NE-30; SE series (produced by Adeka Corporation) such as ADEKA REASOAP SE-10N, ADEKA REASOAP SE-20N and ADEKA REASOAP SE-30N; RN series (produced by Dai-ichi Kogyo Seiyaku Co., Ltd.) such as AQUARON RN-10, AQUARON RN-20, AQUARON RN-30, AQUARON RN-50; HS series (produced by Dai-ichi Kogyo Seiyaku Co., Ltd.) such as AQUARON HS-05, AQUARON HS-10, AQUARON HS-20 and AQUARON HS-30 or BC series; and KH series such as AQUARON KH-05 and AQUARON KH-05.

Examples of nonionic surfactants include polyoxyethylene alkyl ethers such as polyoxyethylene lauryl ether and polyoxyethylene stearyl ether; polyoxyethylene alkyl phenyl ethers such as polyoxyethylene nonyl phenyl ether; sorbitan higher fatty acid esters such as sorbitan monolaurate, sorbitan monostearate, and sorbitan trioleate; polyoxyethylene sorbitan higher fatty acid esters such as polyoxyethylene sorbitan monolaurate; polyoxyethylene higher fatty acid esters such as polyoxyethylene monolaurate and polyoxyethylene monostearate; glycerin higher fatty acid esters such as oleic acid monoglyceride and stearic acid monoglyceride; and polyoxyethylene-polyoxypropylene-block copolymers.

Examples of the amphoteric surfactant include a carboxybetaine type, a silfobetaine type, an aminocarboxylic acid salt, imidazoliumbetaine and so forth. Examples of the cationic surfactant include a fatty amine salt, a fatty quaternary ammonium salt, a benzalkonium salt, a benzethonium chloride salt, a pyridinium salt, an imidazolium salt, and so forth.

The surfactants described above may be used singly or in combination with at least two kinds. Further, the addition amount of a surfactant is 0.001-1.0% by weight, based on weight of colorant particles.

[Dye]

A commonly known dye is usable as a dye constituting colorant particles of the toner of the present invention, but an oil soluble dye is preferably used as the dye constituting colorant particles of the toner of the present invention in view of color reproduction and transparency of the resulting toner. A metal chelate dye is particularly preferable. Since a chelate dye exhibits high absorbance, the same level of storage ability as that of pigment used as a colorant can be obtained with a sufficient level of transparency and chromaticness by utilizing the chelate dye as a dye.

Commonly, oil-soluble dye usable as a dye means water-insoluble dye which is soluble in an organic solvent having no water-soluble group such as a carboxylic acid or a sulfonic acid, and dyes exhibiting oil solubility by salt-forming water-soluble dye with a long-chain base; for example, acid dye, direct dye, reactive dye, salt-forming dye formed with long chain amine, and so forth are included. Concretely, the oil-soluble dye is a dye in which solubility is at most 1% by weight, based on water, and at least 0.01 g/100 ml, based on toluene. In order to measure solubility of dye with respect to toluene, the dye is added into 100 ml of toluene while stirring, and stands for 4 hours to filtrate the resulting, and the weight of dye contained in this solution is subsequently determined after distilling toluene away. Solubility of a dye with respect to water can also be measured similarly to the case of toluene, except that toluene is replaced by water.

Specific examples of such the oil-soluble dye include yellow dyes such as C.I. solvent yellow 2 (2.4), C.I. solvent yellow 3 (3.6), C.I. solvent yellow 5 (5.7), C.I. solvent yellow 7 (1.6), C.I. solvent yellow 8 (2.0), C.I. solvent yellow 17 (1.0), C.I. solvent yellow 24 (0.4), C.I. solvent yellow 30 (3.0), C.I. solvent yellow 31 (2.0), C.I. solvent yellow 35 (5.0), C.I. solvent yellow 44 (0.01), C.I. solvent yellow 88 (0.8), C.I. solvent yellow 89 (5.0), C.I. solvent yellow 98 (2.0), C.I. solvent yellow 102 (0.7), C.I. solvent yellow 103 (1.3), C.I. solvent yellow 104 (0.11), C.I. solvent yellow 105 (0.18), C.I. solvent yellow 111 (0.23), C.I. solvent yellow 114 (0.09), C.I. solvent yellow 162 (40.0) and C.I. disperse yellow 160 (0.02); magenta dyes such as C.I. solvent red 3 (0.7), C.I. solvent red 14 (0.03), C.I. solvent red 17 (1.0), C.I. solvent red 18 (0.8), C.I. solvent red 22 (3.0), C.I. solvent red 23 (1.4), C.I. solvent red 51 (1.4), C.I. solvent red 53 (0.1), C.I. solvent red 87 (0.2), C.I. solvent red 127 (0.3), C.I. solvent red 128 (1.2), C.I. solvent red 131 (0.2), C.I. solvent red 145 (0.2), C.I. solvent red 146 (1.1), C.I. solvent red 149 (0.19), C.I. solvent red 150 (0.07), C.I. solvent red 151 (0.2), C.I. solvent red 152 (0.89), C.I. solvent red 153 (0.8), C.I. solvent red 154 (0.2), C.I. solvent red 155 (0.05), C.I. solvent red 156 (0.5), C.I. solvent red 157 (0.6), C.I. solvent red 158 (0.9), C.I. solvent red 176 (0.05), C.I. solvent red 179 (0.37), C.I. solvent orange 63 (0.02), C.I. solvent orange 68 (0.70), C.I. solvent orange 71 (0.11), C.I. solvent orange 72 (4.9) and C.I. solvent orange 78 (0.33); and cyan dyes such as C.I. solvent blue 4 (0.5), C.I. solvent blue 8 (0.1), C.I. solvent blue 19 (0.1), C.I. solvent blue 21 (0.1), C.I. solvent blue 22 (2.0), C.I. solvent blue 50 (1.0), C.I. solvent blue 55 (5.0), C.I. solvent blue 63 (0.6), C.I. solvent blue 78 (0.12), C.I. solvent blue 82 (0.4), C.I. solvent blue 83 (1.8), C.I. solvent blue 84 (2.8), C.I. solvent blue 85 (0.2), C.I. solvent blue 86 (0.9), C.I. solvent blue 90 (0.45), C.I. solvent blue 91 (1.0), C.I. solvent blue 92 (0.02), C.I. solvent blue 93 (0.1), C.I. solvent blue 94 (0.12), C.I. solvent blue 95 (4.7), C.I. solvent blue 97 (12.5) and C.I. solvent blue 104 (5.0). In addition, solubility of the above-described oil-soluble dye with respect to toluene is represented in ( ), and the unit of solubility is g/100 ml. Solubility of each of the above-described oil-soluble dyes with respect to water was at most 1% by weight.

A metal chelate dye usable as a dye refers to a compound in which a dye atomic group coordinates with a metal ion through at least two-dentate coordination and which may contain a ligand other than the dye atomic group. The ligand refers to an atomic group capable of coordinating with a metal ion, which may contain a charge or not.

Metal chelate dyes usable in the present invention are, for example, compounds represented by following Formula (D):

$$M(Dye)_l(A)_m \qquad \text{Formula (D)}$$

wherein M is a metal ion, "Dye" is a dye capable of coordinating with a metal ion, A is a ligand except for "Dye", l is 1, 2 or 3, and m is 0, 1, 2 or 3. In this case, when m is 0, L is 2 or 3, in which plural "Dye"s may be the same kind or different kind.

Preferable examples of metal ions belonging to 1-8 groups of the periodical table as the metal ion represented by M include Al, Co, Cr, Cu, Fe, Mn, Me, Ni, Sn, Ti, Pt, Pd, Zr, and Zn ions. Ni, Cu, Cr, Co, Zn, and Fe ions are preferable in view of color tone and durability. Cu and Ni ions are also preferable in view of color tone and chromaticness, and Cu ions are further preferable in view of safety. Preferable is a metal chelate dye having a dye represented by "Dye" or chelate composed of aromatic ring hydrocarbon or heterocycle having a site capable of coordinating with a metal ion represented by M through at least two-dentate coordination, and particularly preferable metal chelate dyes are described in Japanese Patent O.P.I. Publication Nos. 9-277693, 10-20559 and 10-30061.

The above-described dyes can be used singly or in combination with at least two kinds, if desired.

Incidentally, carbon black, magnetic material, dye, pigment and so forth are optionally usable as the black colorant. Examples of usable carbon black include channel black, furnace black, acetylene black, thermal black, lamp black and the like. Examples of usable magnetic material also include ferromagnetic metals such as iron, nickel, cobalt and the like; alloys of these metals; ferromagnetic compounds such as ferrite and magnetite; alloys contain no ferromagnetic metal but exhibiting a ferromagnetic property via heat treatment; alloys called Heusler alloys such as manganese-copper-aluminum and manganese-copper-tin; and chrome dioxide.

[Antioxidant]

Discoloration caused by light exposure as well as an oxidized gas such as ozone, active oxygen, Nox or Sox is prevented by an antioxidant. Listed as such the antioxidant may, for example, be antioxidants described in Japanese Patent O.P.I. Publication Nos. 57-74192, 57-87989, and 60-72785; hydrazides described in Japanese Patent O.P.I. Publication No. 61-154989; hindered amine based antioxidants described in Japanese Patent O.P.I. Publication No. 61-146591; nitrogen-containing heterocyclic mercapto based compounds described in Japanese Patent O.P.I. Publication No. 61-177279; thioether based antioxidants described in Japanese Patent O.P.I. Publication Nos. 1-115677 and 1-36479; specifically structured hindered phenol based antioxidants described in Japanese Patent O.P.I. Publication No. 1-36480; ascorbic acids described in Japanese Patent O.P.I. Publication Nos. 7-195824 and 8-150773; zinc sulfate described in Japanese Patent O.P.I. Publication No. 7-149037; thiocyanates described in Japanese Patent O.P.I. Publication No. 7-314882; thiourea derivatives described in Japanese Patent O.P.I. Publication No. 7-314883; saccharides described in Japanese Patent O.P.I. Publication Nos. 7-276790 and 8-108617; phosphoric acid based antioxidants described in Japanese Patent O.P.I. Publication No. 8-118791; nitrites, sulfites, and thiosulfates described in Japanese Patent O.P.I. Publication 8-300807; as well as hydroxylamine derivatives described in Japanese Patent O.P.I. Publication No. 9-267544. Further, employed may be polymerization condensation products of dicyandiamide with polyalkylene polyamine, described in Japanese Patent O.P.I. Publication No. 2000-263928.

The preferable antioxidant comprises a compound represented by foregoing Formula (A) or (B). In Formula (A), $X^1$ represents —$OR^2$ or —$N(R^3)R^4$, and $R^1$ represents —$OR^5$, —$N(R^6)R^7$, —$SR^8$, an alkyl group, an aryl group, —$COX^1$, a cyano group, a nitro group or a halogen atom. $R^1$-$R^8$ each represent an alkyl group or an aryl group, which may be substituted or unsubstituted. Symbol k is an integer of 0-5, and $R^1$-$R^8$ each may be identical or nonidentical with each other when k is 2 or more. Further, in Formula (B), Z represents a hydrogen atom, an alkyl group, an aryl group or —OY. $R^9$ and $R^{10}$ each represent a hydrogen atom, an alkyl group which may be substituted or unsubstituted, or an aryl group which may be substituted or unsubstituted. Y represents an alkyl group which may be substituted or unsubstituted, an aryl group which may be substituted or unsubstituted, or a radical. $R^9$ and $R^{10}$ each may be identical or nonidentical with each other.

Specific example of Formula (A) include compounds represented by following formulae (A-1)-(A-14).
Formula (A-1)
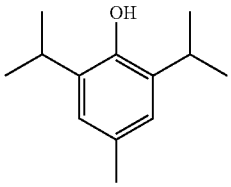
Formula (A-2)
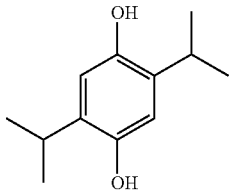
Formula (A-3)
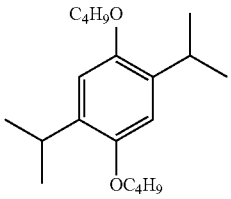
Formula (A-4)
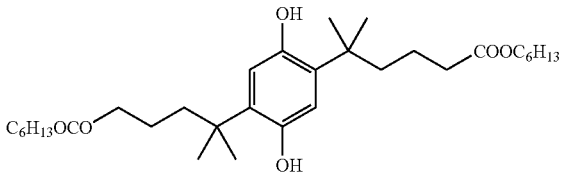
Formula (A-5)
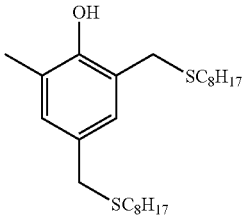
Formula (A-6)
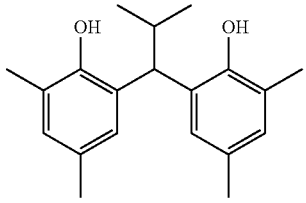
Formula (A-7)
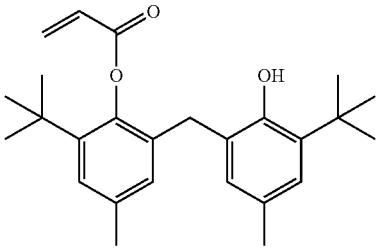
Formula (A-8)
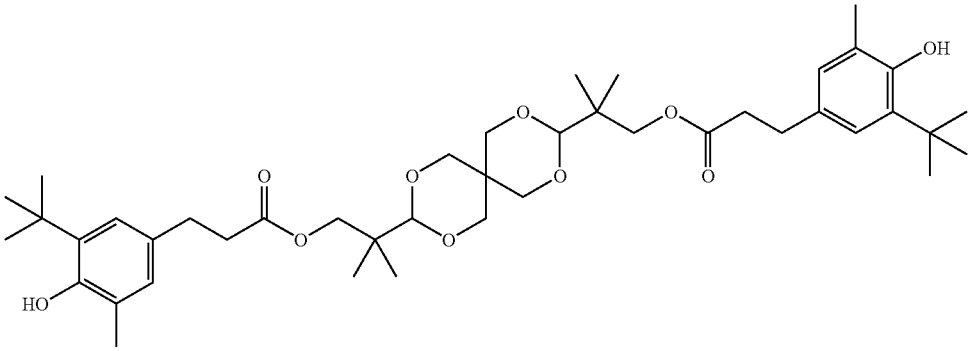
Formula (A-9)
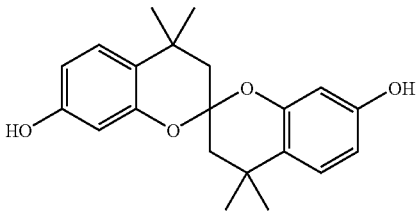
Formula (A-10)
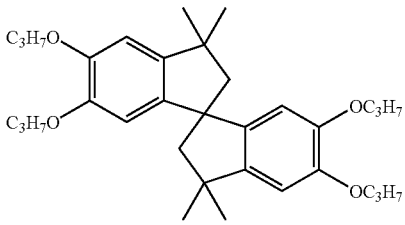

-continued
Formula (A-11)
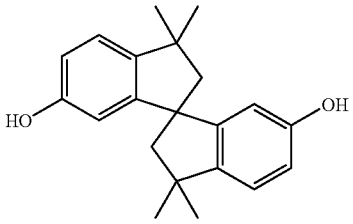
Formula (A-12)
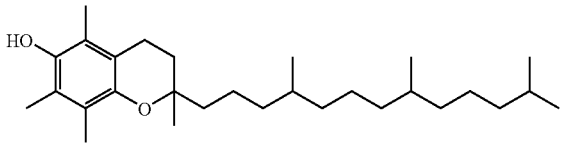
Formula (A-13)
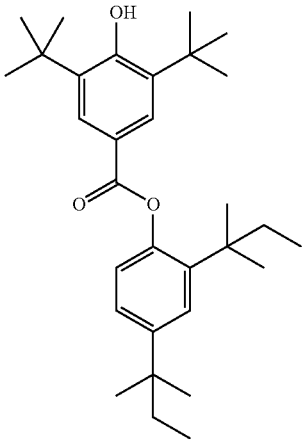
Formula (A-14)
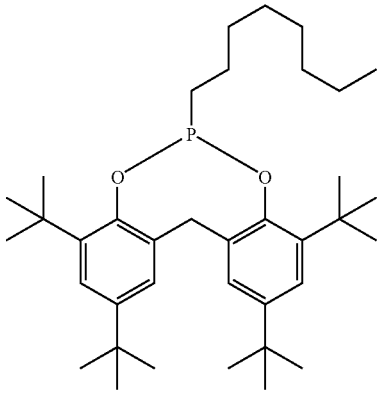
Specific example of Formula (B) include compounds represented by following formulae (B-1)-(B-10).
Formula (B-1)
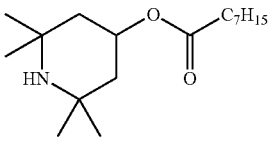
Formula (B-2)
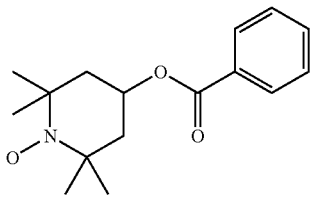
Formula (B-3)
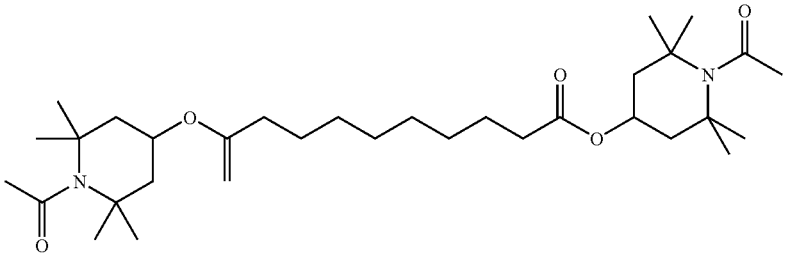

-continued

Formula (B-4)

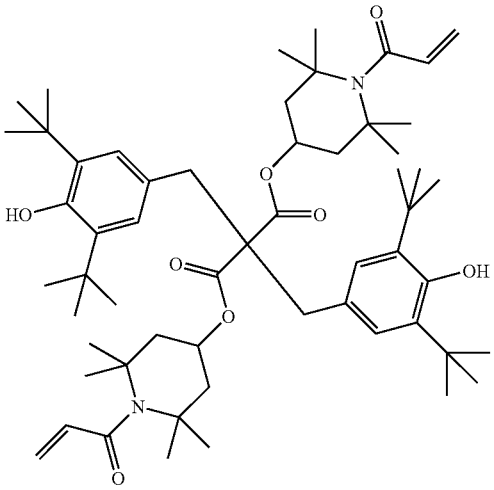

Formula (B-5)

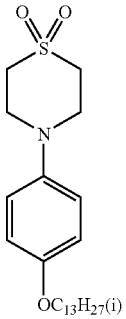

Formula (B-6)

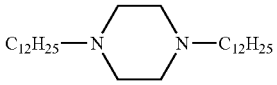

Formula (B-7)

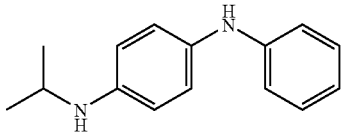

Formula (B-8)

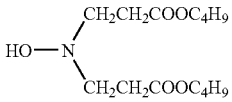

$N(CH_2CH_2OCOCH_2CH_2SC_{12}H_{25})_3$

Formula (B-9)

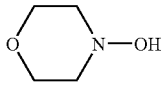

Formula (B-10)

[Dye Medium Resin]

At least one dye medium resin in the case of colorant particles containing a dye medium resin has a weight average molecular weight (Mw) of less than 40,000, and preferably has a weight average molecular weight (Mw) of al least 500 and less than 40,000. Commonly known resin is usable as the dye medium resin, but the resin containing an acetal group is preferable. Specific examples of the resin thereof include polyvinylbutyral, polyvinylacetal and a radical copolymer of a vinyl monomer having a polymerizable ethylenically unsaturated double bond. Examples of specific monomers usable for obtaining the radical copolymer of a vinyl monomer include vinyl acetate, methyl acrylate, ethyl acrylate, n-butyl acrylate, t-butyl acrylate, 2-ethylhexyl acrylate, iso-nonyl acrylate, dodecyl acrylate, octadecyl acrylate, 2-phenoxyethyl acrylate, methyl methacrylate, ethyl methacrylate, n-butyl methacrylate, iso-butyl methacrylate, 2-ethylhexyl methacrylate, 2-hydroxyethyl methacrylate, dodecyl methacrylate, octadecyl methacrylate, cyclohexyl methacrylate, stearyl methacrylate, benzyl methacrylate, glycidyl methacrylate, phenyl methacrylate, styrene, α-methylstyrene, acrylonitrile and acetoacetoxyethyl methaccylate; and further a glycidyl methacrylate modified by soy bean oil aliphatic acid such as "BLEMMER G-FA" (produced by NOF Corporation).

[Toner Binder Resin]

A thermoplastic resin exhibiting sufficient adhesiveness between a toner binder resin and a colorant particle is preferably employed, and a solvent-soluble resin more preferably used. A curable resin to form a three-dimensional structure is also usable, provided that the precursor is solvent-soluble. The resin which is commonly employed as the toner binder resin is not particularly limited, but specific examples of such the toner binder resin include a styrene based resin, an acrylic resin such as alkyl acrylate or alkyl methacrylate, a styrene-acrylic copolymer resin, a polyester resin, a silicone resin, an olefin resin, an amide resin and an epoxy resin. The styrene based resin, acrylic resin and polyester resin exhibiting high transparency and a high sharp-melt property accompanied with low viscosity in meltability are preferably employed in order to improve transparency and color reproduction of superimposed images. There are also used singly or in combination with at least 2 kinds.

In the case of toner particles constituting toner of the present invention prepared by a suspension polymerization method, an emulsion polymerization method or an emulsion polymerization coagulation method, usable examples of polymerizable monomers to obtain the toner binder resin include styrene monomers such as styrene, methylstyrene, methoxystyrene, butylstyrene, phenylstyrene and chlorstyrene; (meth)acrylic acid ester based monomers such as methyl acrylate, ethyl acrylate, butyl acrylate, ethylhexyl acrylate, methyl methacrylate, ethyl methacrylate, butyl methacrylate and ethylhexyl methacrylate; and carboxylic acid based monomers such as acrylic acid, fumaric acid and so forth.

A number average molecular weight (Mn) of such the toner binder resin is preferably 3,000-6,000 and more preferably 3,500-5,500. The ratio of weight average molecular weight (Mw) to number average molecular weight (Mn), Mw/Mn is preferably 2-6 and more preferably 2.5-5.5. The glass transition point of the toner binder resin is preferably 50-70° C., and more preferably 55-70° C.; and the softening point is preferably 90-110° C., and more preferably 90-105° C.

A number average molecular weight of a toner binder resin of less than 3,000 causes releasing in imaging areas when a full color solid image is bent (the resulting toner fixability on bending is deteriorated), and a number-average molecular weight exceeding 6,000 results in lowered heat-meltability in the fixing process, leading to reduced fixing strength. An Mw/Mn of a toner binder resin of less than 2 easily causes high-temperature offset in the fixing process and a Mw/Mn of more than 6 results in deteriorated sharp-melt characteristic in the fixing process, leading to reduced transparency of the resulting toner and deteriorated color-mixing property of a full-color image, together with insufficient color reproduction. A glass transition point of a toner binder resin of lower than 50° C. results in insufficient heat resistance and easily causing coagulation of toner particles during storage and a glass transition point of higher than 70° C. renders it difficult to be melted, resulting in deteriorated fixability and deteriorated color-mixing property of a full-color image, together with insufficient color reproduction. A softening point of a toner binder resin lower than 90° C. easily causes high-temperature offset in the fixing process and a softening point of higher than 110° C. resulting in deterioration in fixing strength, transparency, color-mixing property and glossiness of a full-color image.

A volume-based median particle diameter of toner binder resin particles obtained in a toner binder resin particle polymerization process is preferably 30-500 nm.

[Chain Transfer Agent]

When toner particles constituting toner of the present invention are produced via an emulsion polymerization coagulation method, a commonly known chain transfer agent may be utilized to adjust the molecular weight of a toner binder resin. Utilized chain transfer agents are not specifically limited and include mercaptans or styrene dimmers such as 2-chloroethanol, octyl mercaptan, dodecyl mercaptan, t-dodecyl mercaptan and so forth.

[Polymerization Initiator]

When toner particles constituting toner of the present invention are produced via a suspension polymerization method, an emulsion polymerization method, or an emulsion polymerization coagulation method, a polymerization initiator to obtain a toner binder resin can be employed appropriately if it is a water-soluble polymerization initiator. Examples of the polymerization initiator include persulfates such as potassium persulfate, ammonium persulfate and the like; azo based compounds such as 4,4'-azobis4-cyanovaleric acid, its salts, and 2,2'-azobis(2-amidinopropane) salts; and peroxide compounds.

[Surfactant]

When toner particles constituting toner of the present invention are produced via a suspension polymerization method, an emulsion polymerization method, or an emulsion polymerization coagulation method, examples of usable surfactants thereof include various commonly known ionic surfactants, nonionic surfactants and so forth.

[Coagulant]

When toner particles constituting toner of the present invention are produced via an emulsion polymerization coagulation method, examples of usable coagulants include alkaline metal salts and alkaline earth metal salts. Examples of alkaline metal salts constituting the coagulant include lithium, potassium, sodium and so forth, and examples of alkaline earth metal salts constituting the coagulant include magnesium, calcium, strontium, barium and so forth. Of these, potassium, sodium, magnesium, calcium and barium are preferable. Examples of the counter ion (anion constituting a salt) of the foregoing alkaline metal or alkaline earth metal include a chloride ion, a bromine ion, an iodine ion, a carbonate ion and a sulfate ion.

[Offset Inhibitor]

An offset inhibitor to contribute to prevention of an offset phenomenon may be contained in a toner particle constituting toner of the present invention. Examples of offset inhibitors include polyethylene wax, oxidized polyethylene wax, polypropylene wax, oxidized polypropylene wax, carnauba wax, sazole wax, rice wax, candelilla wax, jojoba oil wax and beeswax, but these are not limited thereto.

As for methods to contain an offset inhibitor in toner particles, there are provided a method of salting out, coagulating and fusing toner binder resin particles, colorant particles and offset inhibitor particles by adding an offset inhibitor particle dispersion (wax emulsion) to form toner particles; and another method of salting out, coagulating and fusing toner binder resin particles containing an offset inhibitor and colorant particles to form toner particles. These methods may also be used in combination. The content ratio of an offset inhibitor in toner particles is commonly 0.5-5 parts by weight, based on 100 parts by weight of binder resin for toner particle formation, and preferably 1-3 parts by weight. When the content ratio of an offset inhibitor in toner particles is less than 0.5 parts by weight, based on 100 parts by weight of binder resin for toner particle formation, sufficient offset prevention can not be effectively obtained, and when the content ratio of an offset inhibitor in toner particles exceeds 5 parts by weight, based on 100 parts by weight of binder resin for toner particle formation, transparency and color reproduction of the resulting toner are degraded.

[Charge Control Agent]

A charge control agent may be contained in toner particles constituting toner of the present invention. The charge control agent is not particularly limited, but various substances are provided to give a positive or negative charge via friction-charging, and a colorless, white or hypochromatic charge control agent is provided as a negative charge control agent usable for toner particles constituting color toner, so as not to adversely affect color tone and transparency of the color toner. Examples of such the charge control agent include a zinc or chromium metal complex of a salicylic acid (salicylic acid metal complex), a calixarene based compound, an organic boron compound, a fluorine-containing quaternary ammonium salt compound and so forth. Specifically provided are the salicylic acid metal complex disclosed in Japanese Patent O.P.I. Publication Nos. 53-127726 and 62-145255, the calixarene based compound disclosed in Japanese Patent O.P.I. Publication No. 2-201378, the organic boron compound disclosed in Japanese Patent O.P.I. Publication No. 2-221967 and the fluorine-containing quaternary ammonium salt compound disclosed in Japanese Patent O.P.I. Publication No. 3-1162. The content ratio of a charge control agent in toner particles is commonly 0.1-10 parts by weight, based on 100 parts by weight of binder resin for toner particle formation, and preferably 0.5-5 parts by weight. The same method as described in a method to contain the foregoing offset inhibitor may be provided as a method to contain internal additives such as a charge control agent and the like in toner particles.

<Particle Diameter of Toner Particle>

Toner particle diameter of the present invention is preferably 4-10 μm in volume-based median particle diameter, and more preferably 6-9 μm. When the method of manufacturing toner is an emulsion polymerization coagulation method and such, for example, this average particle diameter can be controlled with concentration of a coagulant (salting-out agent), an addition amount of an organic solvent, fusing time and a polymer composition. When a volume-based median particle diameter is in the above-described range, transfer efficiency is enhanced, whereby not only halftone image quality is improved, but also fine-line and dot images are improved.

The volume-based median particle diameter of toner can be measured and calculated employing "COULTER MULTISIZER III" (produced by Beckmann Coulter Co.) which was connected to a computer system for data processing (produced by Beckmann Coulter Co.). Specifically, 0.02 g of toner is added into 20 ml of an aqueous surfactant solution (for example, a neutral detergent containing surfactant components is diluted to a factor of 10 with pure water in order to disperse the toner), and dispersed with an ultrasonic homogenizer for 1 minute to prepare a toner dispersion. This toner dispersion is injected by a pipette into a beaker in which ISOTON II (produced by Beckman Coulter Co.) within a sample stand has been placed until reaching a measured concentration of 5-10%. Reproducible measured values here can be obtained by setting the concentration in the above-described range. A counter is set to 25000 counts for the particles to be measured, an aperture diameter is also set to 50 μm, and each frequency value is determined via calculation by dividing the measured range of 1-30 μm into 256 subdivisions. A particle diameter of 50% in cumulative volume fraction from a large cumulative volume fraction designates the volume-based median particle diameter.

<External Additives>

The above toner particle, as it stands, can constitute toner of the present invention, but the toner of the present invention may be prepared by adding external additives such as a fluidizing agent as a so-called posttreatment agent and cleaning aid to improve fluidity, a charging property, a cleaning property and so forth.

Examples of the posttreatment agent include inorganic oxide particles including silica particles, alumina particles, titanium oxide particles and so forth, or inorganic titanate compound particles including strontium titanate particles, zinc titanate particles and so forth. These can be used singly or in combination with at least 2 kinds. It is preferred that these inorganic particles are surface-treated employing a silane coupling agent, a titanium coupling agent, a higher fatty acid or silicone oil, in order to improve heat resistance storage as well as environmental stability.

The total addition amount of these various kinds of external additives is 0.05 parts, based on 100 parts of toner, and preferably 0.1-3 parts. Various kinds of external additives are also usable in combination.

[Developer]

The toner of the present invention is usable as a magnetic or non-magnetic single-component developer, but may be used via mixture with a carrier as a double-component developer. When the toner is used as the double-component developer, usable are magnetic particles made of commonly known metals such as iron, ferrite, magnetite and alloys of the metals with another metal such as aluminum or lead. Of these, ferrite particles are preferable. Also employed as a carrier may be a coat carrier obtained by coating the surface of a magnetic particle with a coating flux such as a resin and the like, or a binder type carrier obtained by dispersing magnetic fine powder in a binder resin. The coated resin constituting a coat carrier is not limited, but examples of the coated resin include an olefin based resin, a styrene based resin, a styrene-acrylic resin, a silicone based resin, an ester resin and a fluorine resin. A commonly known resin is usable as a resin constituting a resin dispersion type carrier with no particular limitation, and examples thereof include a styrene-acrylic resin, a polyester resin, a fluorine resin, a phenol resin and so forth.

The volume-based median particle diameter of the carrier is preferably 20-100 μm, and more preferably 20-60 μm. The volume-based median particle diameter of the carrier can be measured with a laser diffraction type particle size distribution measuring apparatus "HELOS" (produced by Sympatec Co., Ltd.).

Of these carriers, the use of a resin-coated carrier using silicone resin, a copolymer resin (graft resin) of organopolysioxane and a vinyl based monomer or a polyester resin is preferred from the viewpoint of spent resistance. A carrier coated with a resin which is obtained by reacting isocyanate with a copolymer resin of organopolysiloxane and a vinyl monomer, is specifically preferred in terms of durability, environmental stability and spent resistance.

<Image Forming Method>

Toner of the present invention is preferably usable for an image forming method via electrophotography. This image forming method includes at least a process of developing an electrostatic charge image formed on an electrostatic charge image carrier with the toner, and a process of transferring a toner image formed in the developing process onto an image recording medium.

In the case of forming a multicolor image in such the image forming method, there are provided, for example, a transfer process of transferring a plurality of toner images all together onto an Image recording medium after forming them on an electrostatic charge image carrier, and a so-called intermediate transfer process of transferring a toner image formed on an electrostatic charge image carrier one by one onto an intermediate transfer member such as a transfer belt and the like, but the former process is preferable because of what is described later.

Next, the operation to form a full color image via an all-together transfer process will be described, for example. The first toner image (yellow toner image) is formed by conducting the first developing treatment after a uniformly charged electrostatic charge image carrier is exposed to light according to the image information of yellow corresponding to one of the electrostatic charge images obtained by the image information broken down into each color of yellow, magenta, cyan and black. Subsequently, the second toner image (magenta toner image) is formed by conducting the second developing treatment after the electrostatic charge image carrier, on which a yellow toner image is formed, is uniformly charged, and exposed to light according to the image information of magenta. Further, the third toner image (cyan toner image) is formed by conducting the third developing treatment after the electrostatic charge image carrier, on which yellow and magenta toner images are formed, is uniformly charged, and exposed to light according to the image information of cyan. Furthermore, the fourth toner image (black toner image) is formed by conducting the fourth developing treatment after the electrostatic charge image carrier, on which yellow, magenta and cyan toner images are formed, is uniformly charged, and exposed to light according to the image information of black, whereby a full color toner image is transferred all together onto an image recording medium by conducting transfer treatment after forming a full color toner image on the electrostatic charge image carrier. Thereafter, a full color image is obtained by conducting fixing treatment. In this transfer process, a full color image is formed by transferring the full color image formed on an electrostatic charge image carrier all together onto an image recording medium, whereby high image quality can be realized, since it is good enough to conduct transferring treatment as a cause for deteriorated images only once unlike the intermediate transfer process.

According to a developing process in an image forming method with the all-together transfer process as described above, developing treatment is preferably carried out via a non-contact developing process, since a plurality of developing treatment processes are conducted for one image formation. Further, the developing treatment is preferably conducted by applying an alternating electric field.

The toner of the present invention is usable for an image forming method including a fixing process with a contact heating technique as a fixing process; that is, a fixing process in which a toner image transferred onto an image recording medium is brought into contact with a heat member such as a heat roller and so forth. Specific examples for fixing with the contact heating technique include particularly a heat roller fixing process and a pressing contact heat-fixing process in which a rotary heating member including a fixed heating body is used. In the case of using the toner of the present invention, a state of colorant particles adhered onto the image recording medium can also be acquired without deteriorating the colorant particles on the image recording medium in the fixing process with a contact heating technique.

The heat-roll fixing process is operated by an upper roller and a lower roller, wherein the upper roller contains a heat source inside the metal cylinder made of iron and aluminum whose surface is covered with tetrafluoroethylene and polytetrafluoroethylene-per-fluoro alkoxy vinyl ether copolymers; and the lower roller is made of a silicone rubber and others. To put it in greater details, a linear heater is provided as a heat source and is used to heat the upper roller up to the surface temperature of about 120-200° C. In the fixing section, pressure is applied between the upper roller and lower roller to deform the lower roller, whereby a so-called nip is formed. The nip width is 1-10 mm, preferably 1.5-7 mm. The fixing linear speed is preferably 40-600 mm/sec. When the nip width is insufficient, heat cannot be applied uniformly, and uneven fixing will occur. If the nip width is excessive, resin fusion will be accelerated and the problem of excessive fixing offset will arise.

A fixing cleaning mechanism can be provided as required. In this case, it is possible to use the method of supplying silicone oil to the fixing upper roller or film, or the cleaning method using a pad roller web impregnated with silicone oil. In this case, the silicone oil having a high degree of heat resistance is used. The polydimethylsiloxane, polymethylphenyl siloxane, polydiphenyl siloxane and polysiloxane containing fluorine are used. If the viscosity is low, much oil will flow out during the use. Thus, the viscosity at 20° C. is preferably within the range of 1,000-100,000 cp.

According to such the toner, degradation of a dye is effectively prevented by rendering a poisonous gas such as active oxygen being in close vicinity of a dye harmless by the antioxidant action, since a situation where the antioxidant is in close vicinity of the dye in conjunction with colorant particles is possible to be realized, because the dye as a colorant, together with the antioxidant as colorant particles is dispersed in toner particles. As a result, obtained is an electrostatic charge image developing toner exhibiting sufficient transparency and chromaticness, accompanied with high color reproduction and an excellent charging characteristic. The dye structure becomes firmer because of action of an intermolecular force such as Van der Waars' force, a hydrogen bond or a dipole-dipole interaction between the dye and the antioxidant, whereby sufficient storage ability of images together with excellent light fastness, and a high offset resistance property together with heat resistance are obtained. As the result, as to the image formed with this electrostatic charge image developing toner, the image quality can be maintained for a long duration.

Further, undesired dye-to-dye coagulation is prevented, and dependence of a color tone variation upon heating is lowered by mixing a dye and an antioxidant according to colorant particles, whereby excellent chromaticness is also possible to be obtained.

Colorant particles are monodispersed in small particle diameter, whereby transparency with respect to monochrome or superimposed color of toner can further be improved since presence of the component such as opacifying particles that cut off light in toner particles is possible to be lowered as small as possible.

There is no problem produced such that a charging amount of each color of toner fluctuates in the case of employing each color of cyan, magenta, yellow and black, for example, as a cause of a low charging amount of toner employing a regular toner, a high environment dependence indicating a large charging amount difference at high-temperature and humidity as well as low-temperature and humidity or colorant kinds, since the released dye is not exposed on the surface of the toner particle (no migration) according to the above-described toner. Therefore, as to the resulting toner, excellent image properties relating to formed images can be obtained, since a charging characteristic between toner particles becomes substantially even. Further, since no dye is in a molecular state, but in the form of cluster in which some of molecules are coagulated, the dye migration is suppressed, resulting in no problem produced such as dye sublimation, oil contamination and so forth in a fixing process via heat fixing.

EXAMPLE

Next, the present invention will be described referring to specific examples, but the present invention is not limited thereto.

Production Example 1 of Colorant Particle Dispersion

After dissolving 30 g of a dye represented in following Formula (D-1) and 10 g of an antioxidant represented in foregoing Formula (A-13) in 600 g of ethyl acetate, a dye-containing solid solidified by distilling ethyl acetate away under reduced pressure was obtained, and 800 g of an aqueous solution containing 30 g of a surfactant (EM-27C 27% liquid, produced by Kao Corporation) was subsequently introduced into a stainless beaker to disperse the dye-containing solid, and mix it while stirring, employing "ULTRATALUX UTC" (IKA-Werke GmbH). Dispersing treatment was conducted with zirconia beads having a diameter of 0.5 mm, employing a medium type homogenizer SLC-12 (produced by Getzman GmbH) to obtain colorant particle dispersion 1 containing colorant particle 1 having a volume-based median particle diameter of 95 nm. In addition, the volume-based median particle diameter was measured by "NANOTRACK UPA-EX150" (produced by Nikkiso Co., Ltd.).

Formula (D-1)

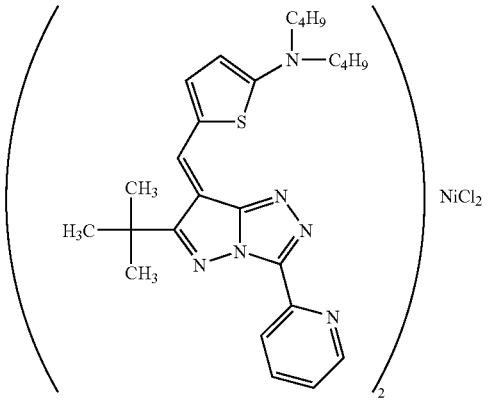

Production Example 2 of Colorant Particle Dispersion

Colorant particle dispersion 2 containing colorant particle 2 having a volume-based median particle diameter of 118 nm was prepared similarly to preparation of production Example 1 of colorant particle dispersion, except that 30 g of a surfactant (EM-27C 27% liquid) is replaced by a surfactant (NC-2308SF 30% liquid).

Production Example 3 of Colorant Particle Dispersion

First, 15 g of a dye represented in following Formula (D-2) and 7.5 g of an antioxidant represented in foregoing Formula (A-14) were dissolved in 200 g of ethyl acetate. Next, emulsifying treatment was conducted for 300 seconds employing CLEARMIX W-MOTION CLM-0.8W (produced by M-Technique Co., Ltd.) after dripping 240 g of an aqueous solution containing 8 g of AQUALON KH-05 (produced by Dai-ichi Kogyo Seiyaku Co., Ltd.). Subsequently, ethyl acetate was removed under reduced pressure to prepare colorant particle dispersion 3 containing colorant particle 3 having a volume-based median particle diameter of 39 nm.

Formula (D-2)

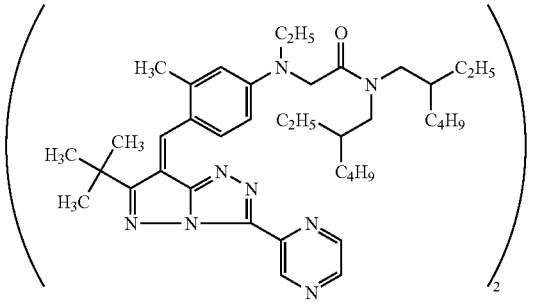

-continued

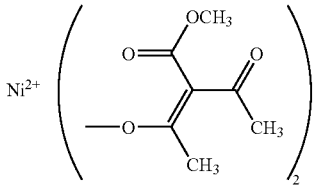

Production Example 4 of Colorant Particle Dispersion

Colorant particle dispersion 4 containing colorant particle 4 having a volume-based median particle diameter of 45 nm was prepared similarly to preparation of production Example 3 of colorant particle dispersion, except that a polymer mixed by a ratio of 50:styrene (ST)/30: acetoacetoxymethacrylate (AAEM)/20:stearylmethacrylate, together with dye (D-2) and oxidant (A-14) was dissolved in ethyl acetate.

Production Example 5 of Colorant Particle Dispersion

Colorant particle dispersion 5 containing colorant particle 5 having a volume-based median particle diameter of 62 nm was prepared similarly to preparation of production Example 3 of colorant particle dispersion, except that dye (D-2) was replaced by dye "solvent blue 70" (produced by BASF).

Comparative Production Example Z of Colorant Particle Dispersion

A dye solution in which 15.0 g of dye (D-2) represented in above Formula (D-2) was dissolved in 200 g of ethyl acetate was obtained. Next, emulsifying treatment was conducted for 300 seconds employing CLEARMIX W-MOTION CLM-0.8W (produced by M-Technique Co., Ltd.) after dripping 240 g of an aqueous solution containing 8 g of a surfactant "Aqualon KH-05" (produced by Dai-ichi Kogyo Seiyaku Co., Ltd.) onto a dye solution. Subsequently, ethyl acetate was removed under reduced pressure to prepare comparative colorant particle dispersion Z containing comparative colorant particle Z having a volume-based median particle diameter of 78 nm.

Colorant Particles in Colorant Particle Dispersion

As to the above-described colorant particle dispersions 1-5 and comparative colorant particle dispersion Z, the CV value of colorant particles contained can be calculated from foregoing Equation (1) by measuring the volume-based median particle diameter of colorant particles employing "MICROTRACK UPA150" (produced by Nikkiso Co., Ltd.), and finding the cumulative curve by setting the total value to 100% with particle diameters corresponding to 16%, 50% and 84% of the cumulative curve which were designated as $d_{16}$, $d_{50}$ and $d_{84}$, respectively. The results are shown in Table 1.

TABLE 1

| Colorant particle dispersion | Particle diameter (nm) | CV value (%) |
|---|---|---|
| Example 1 | 95 | 53 |
| Example 2 | 118 | 59 |
| Example 3 | 39 | 28 |
| Example 4 | 45 | 38 |
| Example 5 | 62 | 37 |
| Comparative example Z | 78 | 45 |

Production Example of Antioxidant Dispersion (for Comparison)

An antioxidant solution in which 7.5 g of antioxidant (A-14) represented in above Formula (A-14) was dissolved in 100 g of ethyl acetate was obtained. Next, emulsifying treatment was conducted for 150 seconds employing CLEARMIX W-MOTION CLM-0.8W (produced by M-Technique Co., Ltd.) after dripping 120 g of an aqueous solution containing 4 g of a surfactant "AQUALON KH-05" (produced by Dai-ichi Kogyo Seiyaku Co., Ltd.) onto an antioxidant solution. Subsequently, ethyl acetate was removed under reduced pressure to prepare antioxidant dispersion Y.

A surfactant solution (aqueous medium), in which 7.08 g of an anionic surfactant (sodium dodecylbenzenesulfonate: SDS) was previously dissolved in 2760 g of ion-exchange water, was charged into a separable flask of 5000 ml fitted with a stirrer, a thermal sensor, a cooling pipe and a nitrogen-introducing device, and the internal temperature was increased while stirring at a stirring rate of 230 rpm under a stream of nitrogen. Separately, 72.0 g of a compound represented by following Formula (C) as an offset inhibitor was added into a monomer mixture containing 115.2 g of styrene, 42.0 g of n-butyl acrylate and 10.9 g of methacrylic acid, and dissolved with heating to 80° C. to prepare a monomer solution. Using a mechanical disperser having a circulation path, the above monomer solution (80° C.) was mixed and dispersed in the foregoing surfactant solution to prepare a dispersion of emulsion particles (oil droplets) having a uniform dispersion particle diameter. Subsequently, an initiator solution, in which 0.84 g of a polymerization initiator (potassium persulfate:KPS) was dissolved in 200 g of ion-exchange water, was added into this dispersion, and the resulting was heated at 80° C. for 3 hours while stirring, to perform polymerization (first polymerization) and to prepare latex (A). Subsequently, an initiator solution in which 7.73 g of a polymerization initiator (KPS) was dissolved in 240 ml of ion-exchange water, was added into this latex (A), and after 15 minutes, a monomer mixture containing 383.6 g of styrene, 140.0 g of n-butyl acrylate, 36.4 g of methacrylic acid and 13.7 g of tert-dodecylmercaptan was added dropwise at 80° C. over a period of 120 minutes. After completing addition, polymerization (second polymerization) was conducted via heating while stirring for 60 minutes. Then the reaction mixture was cooled to 40° C. to obtain latex (B).

$$C\{CH_2OCO(CH_2)_{20}CH_3\}_4 \qquad \text{Formula (C)}$$

Production Example 1 of Toner

First, 1250 g of latex (B), 2000 ml of ion-exchange water, 90 g of colorant particle dispersion 1 were charged into a four-necked flask of 5 liter fitted with a thermal sensor, a cooling pipe and a nitrogen-introducing device, a stirrer, and were stirred to prepare a association solution. After adjusting an internal temperature of this association solution to 30° C., a sodium hydroxide solution of 5N was added to adjust pH to 10.0. Next, a solution, in which 52.6 g of magnesium chloride hexahydrate was dissolved in 72 ml of ion-exchange water, was subsequently added white stirring at 30° C. for 10 minutes. After standing for 3 minutes, temperature of this solution was increased to 90° C. spending 6 minutes (temperature-increasing rate: 10° C./min.). In this situation, an average particle diameter of associated particles was measured in this situation employing "COULTER COUNTER TA-II" (produced by Coulter, Inc.), and a solution in which 115 g of sodium chloride was dissolved in 700 ml of ion-exchange water was added to terminate particle growth at the time when the volume-based median particle diameter reached 6.5 μm. Further, the fusing process was continued by heat-treating at a liquid temperature of 90° C.±2° C. while stirring for 6 hours, and the system was subsequently cooled down to 30° C. at a rate of 6° C./min. After associated particles were filtrated from this associated particle dispersion, and conducted was a washing treatment process in which total associated particles were dispersed again in 10 times the amount of ion-exchange water (pH=3) by a weight ratio, the process to filtrate associated particles from washing water were repeated twice, and then washing treatment was conducted with only ion-exchange water to obtain toner 1 formed from toner particles acquired via drying with hot air of 40° C.

Production Example 2 of Toner

Toner 2 was prepared similarly to preparation of production Example 1 of toner, except that colorant particle dispersion 1 was replaced by colorant particle dispersion 2, under the condition of the content of addition dye being equivalent.

Production Example 3 of Toner

Toner 3 was prepared similarly to preparation of production Example 1 of toner, except that colorant particle dispersion 1 was replaced by colorant particle dispersion 3, under the condition of the content of addition dye being equivalent.

Production Example 4 of Toner

Toner 4 was prepared similarly to preparation of production Example 1 of toner, except that colorant particle dispersion 1 was replaced by colorant particle dispersion 4, under the condition of the content of addition dye being equivalent.

Production Example 5 of Toner

Toner 5 was prepared similarly to preparation of production Example 1 of toner, except that colorant particle dispersion 1 was replaced by colorant particle dispersion 5, under the condition of the content of addition dye being equivalent.

Production Example 1 of Comparative Toner

Comparative toner 1 was prepared similarly to preparation of production Example 1 of toner, except that colorant particle dispersion 1 was replaced by comparative colorant particle dispersion Z, under the condition of the content of addition dye being equivalent. This comparative toner 1 is toner in which colorant particles having no antioxidant are made of only dye.

Production Example 2 of Comparative Toner

Comparative toner 2 was prepared similarly to preparation of production Example 1 of comparative toner, except that colorant particle dispersion 1 was replaced by comparative colorant particle dispersion Z, under the condition of the content of addition dye being equivalent, and further half the amount added was antioxidant dispersion Y when adding comparative colorant particle dispersion Z. As to this comparative toner 2, no antioxidant is contained in colorant particles, but contained in toner particles.

Production Example 3 of Comparative Toner

Comparative toner 3 was prepared similarly to preparation of production Example 1 of comparative toner, except that after obtaining a solution, in which 3.5 g of dye "solvent blue 70" (produced by BASF) and 1.75 g of antioxidant (A-14) were dissolved in 100 ml of tetrahydrofran (THF), 1250 g of latex (B) was dripped onto this solution while stirring for 30 minutes, and dye-containing latex (C) prepared by distilling THF away under reduced pressure was subsequently employed. As to this comparative toner 3, a dye and an antioxidant are contained in toner particles in the dissolving state.

Regarding the above-described toners 1-5 and comparative toners 1-3, the shape factor and the CV value of the colorant particle in the toner particle can be determined as follows. The epoxy embedded $RuO_4$ dye ultrasectioning method accompanied with a transmission electron microscope H-7100 (manufactured by Hitachi, Ltd.) was first used, a cross sectional image at a magnification of 50000 times into a "LUZEX image analysis apparatus" (manufactured by Nireco Corporation) was subsequently captured to observe 100 colorant particles, and the maximum length and projected area were obtained, whereby the CV value was calculated from foregoing Equation (1) by calculating a volume-based median particle diameter from an equivalent circular diameter of the projected area, and finding the cumulative curve by setting the total value to 100%; and particle diameters corresponding to 16%, 50% and 84% of the cumulative curve were designated as $d_{16}$, $d_{50}$ and $d_{84}$, respectively. The results are shown in following Table 2. As to the above-described toners 1-5 and comparative toners 1-3, 0.01 g of the toner particle was sampled, and spectroscopy spectrum measurement of the solution dissolved in 20 g of toluene was conducted employing a spectrophotometer V-570 (manufactured by JASCO International CO., Ltd.) to calculate the dye content, using the absorption constant for pre-quantitated dye.

External Additive Treatment

To toner particles of each of toners 1-5 and comparative toners 1-3, hydrophobic silica (having a number-average particle diameter of 12 nm and a hydrophobicity degree of 68) and hydrophobic titanium oxide (having a number-average particle diameter of 20 nm and a hydrophobicity degree of 63) as external additives were added at 1.0% by weight and 1.2% by weight, respectively and mixed employing a HENSCHEL mixer (produced by Mitsui Miike Kakoki-sha). Thereafter, coarse particles were removed using a sieve having an opening of 45 μm to obtain toners 1-5 and comparative toners 1-3 used for developer. Addition of hydrophobic silica or hydrophobic titanium oxide caused no variation in form or particle diameter.

Examples 1-5 and Comparative Examples 1-3

Each of toners 1-5 and comparative toners 1-3 used for developer is mixed with ferrite carrier having a volume-based median particle diameter of 60 μm in such a way that the content of toner for developer is 6% by weight, to prepare developers 1-3 and comparative developers 1-3 as double-component developers. These developers 1-5 and comparative developers 1-3 were feasibly evaluated employing "BIZHUBC250" (manufactured by Konica Minolta Business Technologies, Inc.). The results are shown in Table 2.

(1) Dye Deposit Amount

An image, in which a toner deposit amount on a transfer paper sheet was varied in the range of 0.1-1.0 mg/cm$^2$, was formed to measure transfer paper sheet weight W1 before fixing treatment. After blowing toner away with an airgun, transfer paper sheet weight W2 was measured to obtain ΔW (difference between W1 and W2) as the deposit. A dye deposit amount was calculated from following Equation (2), and the dye deposit amount, in which the dye deposit amount range of 5-30 μg/cm$^2$ maximizes chromaticness, was obtained as the maximum deposit amount.

$$\text{Dye deposit amount } (\mu g/cm^2) = \Delta W \times \text{Dye content } (\%)/100 \qquad \text{Equation (2):}$$

(2) Chromaticness

On the other hand, an image, in which a toner deposit amount on a transfer paper sheet was similarly varied in the range of 0.1-1.0 mg/cm$^2$, and L*a*b* color space diagram of each image was obtained employing a color-difference meter "CM-2002" (manufactured by Minolta Co., Ltd.) to calculate Chromaticness C* from following Equation (3).

$$\text{Chromaticness } (C^*) = [(a^*)^2 + (b^*)^2]^{1/2} \qquad \text{Equation (3)}$$

where a* and b* represent values of a* coordinate and B* coordinate, respectively. Chromaticness generally increases up to a certain range with increase of toner deposit amount (dye deposit amount), but when the toner deposit amount exceeds a certain value, chromaticness is saturated and then decreases.

(3) Color Tone Variation

An image, in which a toner deposit amount on a transfer paper sheet was varied in the range of 0-1.0 mg/cm$^2$, was formed, and color tone variation was ranked via evaluation as indicated below, employing following Equation (4).

A: ΔE is less than 2 (Particularly excellent with no color tone variation).

B: ΔE is at least 2 and less than 5 (Excellent with almost no color tone variation).

C: ΔE is at least 5 and less than 10 (Practically with no problem, but slight color tone variation).

D: ΔE is 10 or more (Problem in image quality with a large color tone variation).

$$E = [(L1^* - L2^*)^2 + (a1^* - a2^*)^2 + (b1^* - b2^*)^2]^{1/2} \qquad \text{Equation (4):}$$

where L1* is a value of L* before heat resistance test and L2* is a value of L* after heat resistance test, a1* is a value of a* before heat resistance test and a2* is a value of a* after heat resistance test and b1* is a value of b* before heat resistance test, and b2* is a value of b* after heat resistance test.

(4) Transparency

An image formed on a previously colored transfer paper sheet was observed visually and ranked via evaluation whether or not it is appropriate as secondary color.

A: Color reproduction is particularly excellent.

B: Color reproduction is excellent.

C: A slight opacifing and scattering observed (Practically with no problem).

D: Large opacifing and scattering observed (Problem in image quality).

(5) Light Fastness

An image portion with image density of an image fixed on a transfer paper sheet being approximately 1.0 was exposed to light employing a light fastness meter "low temperature Xe weather meter XL75" (manufactured by Suga Test Instruments Co., Ltd.), and the image density at the portion was subsequently measured with "X-RITE 900" (manufactured by Nippon Heiban kizai K.K.) to determine and rank a remaining ratio of image density with respect to the original image density, employing following Equation (5).

EFFECT OF THE INVENTION

According to an electrostatic charge image developing toner of the present invention, degradation of a dye is effectively prevented by rendering a poisonous gas such as active oxygen being in close vicinity of a dye harmless by the antioxidant action, since a situation where the antioxidant is in close vicinity of the dye in conjunction with colorant particles is possible to be realized, because the dye as a colorant, together with the antioxidant as colorant particles is dispersed in toner particles. As a result, obtained is an electrostatic charge image developing toner exhibiting sufficient transparency and chromaticness, accompanied with high color reproduction and an excellent charging characteristic. The dye structure becomes firmer because of action of an intermolecular force such as Van der Waars' force, a hydrogen bond or a dipole-dipole interaction between the dye and the antioxidant, whereby sufficient storage ability of images together with excellent light fastness, and a high offset resistance property together with heat resistance are obtained. As the result, as to the image formed with this electrostatic charge image developing toner, the image quality can be maintained for a long duration.

Further, undesired dye-to-dye coagulation is prevented, and dependence of a color tone variation upon heating is lowered by mixing a dye and an antioxidant at a molecular level according to colorant particles, whereby excellent chromaticness is also possible to be obtained.

TABLE 2

| | Particle diameter (nm) | CV value (%) | Dye content (%) | Kinds of dye | Evaluated results: Maximum coating amount (μg/cm$^2$) | Chromaticness | Color tone | Transparency | Light fastness |
|---|---|---|---|---|---|---|---|---|---|
| Example 1 | 105 | 56 | 1.52 | Magenta dye | 27 | 80 | B | B | A |
| Example 2 | 130 | 67 | 1.56 | Magenta dye | 23 | 79 | C | C | B |
| Example 3 | 44 | 30 | 1.54 | Magenta dye | 26 | 84 | B | B | A |
| Example 4 | 58 | 42 | 1.55 | Magenta dye | 24 | 83 | B | B | A |
| Example 5 | 65 | 40 | 1.56 | Cyan dye | 25 | 61 | B | B | B |
| Comparative example 1 | 65 | 48 | 1.57 | Magenta dye | 27 | 77 | C | B | D |
| Comparative example 2 | 63 | 45 | 1.55 | Magenta dye | 27 | 78 | C | B | D |
| Comparative example 3 | — | — | 1.11 | Cyan dye | 25 | 55 | D | C | C |

As is clear from Table 2, it is to be understood that developers 1-5 exhibit excellent chromaticness and transparency, whereby images in high quality can be steadily formed, and not so much color tone varies, together with extremely high light fastness, whereby images in high quality can be maintained for a long duration. On the other hand, regarding toner of Comparative example 1 having a structure composed only of a dye with no antioxidant contained in colorant particles, color tone variation and insufficient light fastness were observed, though sufficient transparency and chromaticness were obtained. Regarding toner of Comparative example 2 having a structure in which no antioxidant is contained in colorant particles, but contained in toner particles, also confirmed was only the same level of light fastness and color tone variation as in the case of toner of Comparative example 1 containing no antioxidant. Further, regarding toner of Comparative example 3 having a structure in which a dye and an antioxidant are contained in a dissolving state in toner particles, insufficient chromaticness and transparency, together with large color tone variation were observed, though a certain level of light fastness was observed. It is considered that a situation where the antioxidant is not sufficiently in close vicinity of the dye was realized.

What is claimed is:

1. An electrostatic charge image developing toner comprising toner particles, each toner particle comprising colorant particles dispersed in a binder resin, wherein the colorant particles comprise a dye, an antioxidant, and at least one dye medium resin, the at least one dye medium resin is different in kind from the binder resin, the at least one dye medium resin has a weight average molecular weight (Mw) of at least 500 and less than 40,000.

2. The electrostatic charge image developing toner of claim 1, wherein a volume-based median particle diameter of the colorant particles is 10-100 nm.

3. The electrostatic charge image developing toner of claim 1, wherein a weight ratio of the antioxidant to the dye (antioxidant/dye) is in the range of 0.1/1-1/1.

4. The electrostatic charge image developing toner of claim 1, wherein the dye is an oil-soluble dye.

5. The electrostatic charge image developing toner of claim 1, wherein the dye is a metal chelate dye.

6. An image forming method employing the electrostatic charge image developing toner of claim 1, comprising the steps of:

(a) developing an electrostatic charge image formed on an electrostatic charge image carrier with the electrostatic charge image developing toner; and (b) transferring a toner image formed in step (a) onto an image recording medium.

* * * * *